United States Patent [19]

Kowalski

[11] Patent Number: 5,074,128

[45] Date of Patent: Dec. 24, 1991

[54] EARRING

[76] Inventor: Gail E. Kowalski, Rte. 1, Box 181, Nags Head, N.C. 27959

[21] Appl. No.: 860,094

[22] Filed: May 6, 1986

[51] Int. Cl.[5] ..... A44C 7/00

[52] U.S. Cl. ..... 63/12; 11/40

[58] Field of Search ..... D11/40, 43, 45; 63/12, 63/13, 14 G, 20

[56] References Cited

U.S. PATENT DOCUMENTS

| | | | |
|---|---|---|---|
| 4,249,393 | 2/1981 | Ciambra | 63/12 |
| 4,282,721 | 8/1981 | Roach et al. | 63/14 R |

FOREIGN PATENT DOCUMENTS

| | | | |
|---|---|---|---|
| 1072759 | 3/1980 | Canada | 63/13 |
| 809579 | 2/1959 | United Kingdom | 63/12 |
| 1269570 | 4/1972 | United Kingdom | 63/14 G |

OTHER PUBLICATIONS

Donald Miller, Post-Gazette Art Critic, Jan. 1984, page (unknown).

Anon. Mart Jeweler's Circular-Keystone vol. and No. (unkonwn) Jul. 1985 p. 34 Kirie Corporation.

Jewelry Career Hers by Design, Pittsburgh Post--Gazette Jan., 1984, by Donald Miller, Art Critic.

*Primary Examiner*—Robert H. Hafer

*Assistant Examiner*—Michael Brown

*Attorney, Agent, or Firm*—Webb Burden Ziesenheim & Webb

[57] ABSTRACT

An earring for wearing on a pierced earlobe having a protuberance for mounting on the outside of the earlobe and a substantially vertical pendant portion for passage through the earlobe and for extending downwardly from the earlobe for wearing at a level below the earlobe. The pendant is connected to the protuberance by means of a substantially horizontal wire-like bridge which can penetrate the pierce and which spans the earlobe during wearing. The pendant has at least one region which is enlarged relative to the diameter of the wire-like bridge. The horizontal bridge and the enlarged portion of pendent can be manually forced through the pierce during mounting but both features resist slippage of the earring and loss thereof during wearing.

16 Claims, 1 Drawing Sheet

EARRING

Figure 12:
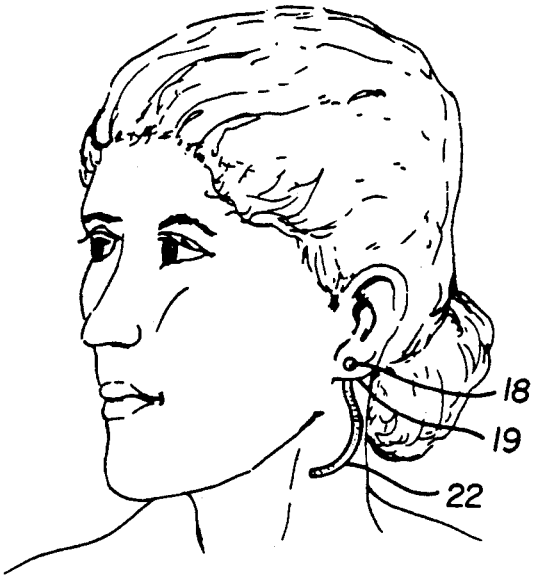

This invention relates to an earring for use as jewelry for insertion through a pierced earlobe of a wearer.

The invention relates to an ornamental earring wherein each earring of a pair comprises an integral one-piece structure. The one-piece structure can comprise all the ornamental and functional features of the earring and no separate ornamental or functional parts are required. The design is adapted to facilitate easy mounting on the ear and to resist slippage from the ear during wearing. The structure is adapted for use with a pierced earlobe and no moveable screws or clips are required to secure the earring in place.

A prior art one-piece earring has been known to be worn on a pierced earlobe wherein the earring has an ornamental protuberance which is worn on the outside of the earlobe and which has a substantially vertical pendant of essentially uniform width sufficiently small for passage through the earlobe and extending downwardly to be worn below the earlobe. In the prior art earring, the top of the pendant was bent relatively slightly to form an angle of at least 120 degrees with respect to the vertical portion The slightness of the bend in the prior art earring contributed to the significant disadvantage of the tendency of the earring to slip off of the ear of a wearer and become lost without any awareness on the part of the wearer.

The earring of the present invention tends to overcome the slipping disadvantage of the prior art earring through structural modifications which cause the earring to resist slippage from the ear when being worn and which provide aesthetic enhancement of the earring. The structural modifications of the earring of this invention include the incorporation of a generally horizontal wire-like shoulder between the ornamental protuberance and the vertical pendant which bridges or spans the earlobe and is worn at the level of the earlobe at the pierce plus the provision of a region in the pendant which is enlarged relative to the horizontal shoulder and which extends downwardly from the earlobe. The enlarged region can comprise a flattened zone in an otherwise wire-like pendant where the largest transverse dimension in the flattened zone is wider than the diameter of the horizontal shoulder. The transverse dimension of the flattened zone permits the pendant to be manually passed through the earlobe although it resists any extensive inadvertent reverse movement of the earring to an extent tending to dislodge the earring from the earlobe.

Protection against loss during use by unnoticed slippage from an earlobe of an earring of this invention requires a pendant length of at least 1.5 inches for a pendant which is essentially straight or only gently curved or saber shaped. Protection against loss can also be imparted by shaping the pendant in other than a straight or gently curved configuration. For example, the pendant can have a wave-like configuration, an oval configuration, a curl configuration, a corkscrew configuration, etc. Such pronounced pendant curvatures resist inadvertent or accidental slippage of the earring from the earlobe during use, obviating a minimum length requirement.

A friction, drag or resistance to slippage effect is a primary functional feature of an earring of this invention. The earring of the prior art had a uniform width throughout except for the protuberance, and the width was too narrow to maintain the earring in place on the ear. An improvement of this invention comprises varying the width of the earring from a relatively narrow thickness in the region of the earlobe to a larger thickness dimension at some position in the pendant, preferably at a position relatively near the earlobe or at least at an intermediate position along the length of the pendant. One suitable pendant is relatively narrow at the top and bottom and relatively wide in the middle with the wider portion tapering off in width at both ends.

The circumference of the earring can be round and wire-like at the shoulder spanning the earlobe where its diameter is relatively small in order to be comfortable to the wearer. The wider portion of the earring along the length of the pendant can be round and wirelike, but of a larger diameter than the diameter at the earlobe. The larger portion can also be flat, square or triangular, but of a larger transverse dimension than the smallest transverse dimension, i.e. the diameter at the earlobe. If a flat, square or triangular configuration is employed in any region of the earring, the sharp edges are advantageously rounded off so as to avoid irritating the earlobe of the wearer during insertion through the pierce.

An advantageous ratio of the wide to narrow transverse dimensions is at least 1.5 to 1, preferably at least 2 to 1. The smaller transverse dimension at the shoulder can be generally 0.5 mm to 1.25 mm. Depending on the size of the pierce, the smaller dimension can be larger or smaller than these values, while maintaining a wide to narrow transverse dimension ratio of at least 1.5 to 1.

The protuberance at the earlobe serves as a mechanical stop and can be the only portion of the earring that is too large to pass through the pierce in the earlobe. It suitably has a diameter of at least 1.9 mm. It can be of a desired shape, such as round, square, button-shaped, etc.

The shoulder connecting the pendant and the protuberance which spans the pierce from the outside to the inside of the earlobe forms a maximum angle of generally 110 degrees with the top of the pendant, preferably forms a maximum angle of 100 degrees with the top of the pendant and most preferably forms a maximum angle of 90 degrees with the top of the pendant. Therefore, the shoulder can be substantially horizontal and differs distinctly from the steeply sloped pierce spanning region of the prior art earring, contributing to the stability of the earring during use.

Figure 1:
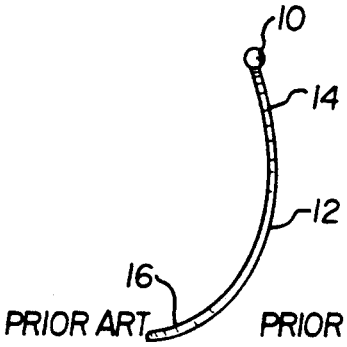
Figure 2:
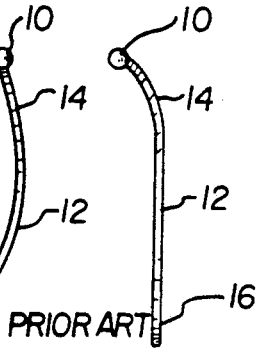
Figure 3:
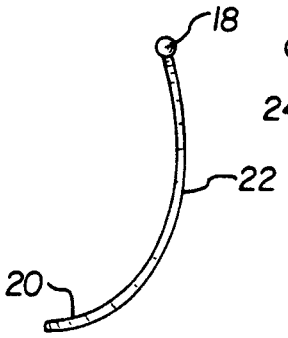
Figure 4:
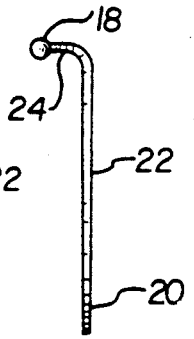
Figure 5:
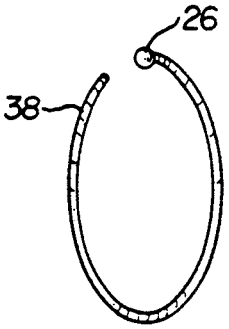
Figure 6:
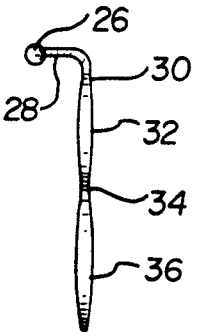
Figure 7:
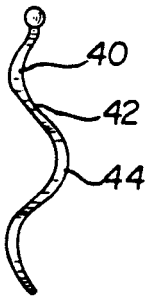
Figure 8:
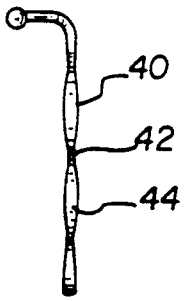
Figure 9:
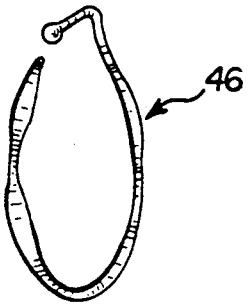
Figure 10:
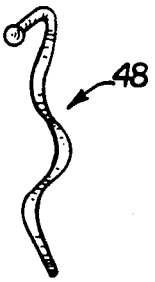
Figure 11:
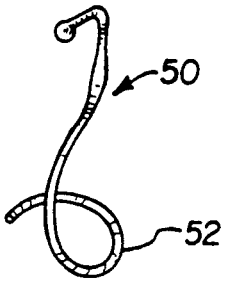

These and other advantages of this invention will become apparent by reference to the attached figures in which FIGS. 1 and 2 are a side view and front view as worn, respectively, of an earring of the prior art, FIGS. 3 and 4 are a side view and front view as worn, respectively, of an earring of this invention, FIGS. 5 and 6 are a side view and front view as worn, respectively, of an oval shaped earring of the invention, FIGS. 7 and 8 are a side view and front view as worn, respectively, of a wave shaped earring of the invention, FIG. 9 is an isometric view of the oval shaped earring of FIGS. 5 and 6, FIG. 10 is an isometric view of the wave shaped earring of FIGS. 7 and 8, FIG. 11 is an isometric view of a curled earring of the invention, and FIG. 12 illustrates the mounting of the earring on the earlobe of a wearer.

Referring to the prior art earring of FIGS. 1 and 2, 10 is a round protuberance or mechanical stop which is the only portion of the earring which is too large to pass through the pierce of an earlobe and which rests at the exterior of the earlobe outside the pierce. The remainder of the earring is generally wire-like or has an intermediate flat region of about the same width as the diameter of the wire-like portion. 12 represents the pendant portion of the earring having a curved terminus 16 which gives the pendant a saber shape and which is the first portion to penetrate the pierce during mounting. The earring has another curved portion 14 which bridges the earlobe. In the prior art earring, the curved portion 14 forms an angle of at least 120 degrees with respect to vertical pendant 12, so that there is no defined shoulder structure.

Referring to FIGS. 3 and 4, 18 represents a protuberance which is the only portion of the earring of the invention which is too large to penetrate the pierce and which rests against the earlobe. The terminus 20 is wire-like but can be flat, and is the first portion of the earring to penetrate the pierce, followed by a relatively enlarged flattened or round second region 22. The terminus 20 is shown as curved forwardly but it can be similarly curved rearwardly or to a side, as desired for ornamental purposes. Finally, a horizontal wire-like shoulder portion 24 connects the vertical region of pendant portion 22 with protuberance 18. Shoulder portion 24 is the portion that spans the pierce to the opposite sides of the earlobe during wearing. Shoulder 24 preferably forms an angle of no more than 90 degrees with respect to vertical pendant 22, but can form an angle of less than 100 or 110 degrees with respect to vertical pendant 22.

As shown in FIG. 12, horizontal shoulder 24 allows protuberance 18 to rest flush on the outside surface of an earlobe 19 of a wearer so that pendant 22 depends vertically from the inside of earlobe 19.

Comparing the earring of the invention shown in FIGS. 3 and 4 with the earring of the prior art shown in FIGS. 1 and 2, it will be apparent that the earring of the invention provides two structural features adapted to prevent slippage of the earring from the desired fitted position, or from the ear, when worn. The first such structural feature is horizontal shoulder 24 to replace a more nearly vertical region 14. The substantially horizontal nature of shoulder 24 makes it more difficult for the earring to slip. In contrast, the more vertical region 14 of the prior art earring provides much less resistance against slippage of the earring from the earlobe. The second such structural feature is enlarged region 22 of the pendant which replaces non-enlarged region 12. Enlarged region 22 is sufficiently large to resist reverse unnoticed slippage during wearing but is sufficiently small to be forced manually through the pierce during mounting on the earlobe.

The earring of FIGS. 5 and 6 possesses protuberance 26, horizontal bridge 28 and a plurality of relatively narrow and wide regions 30, 32, 34 and 36, respectively, in the pendant portion. The pendant portion curves back onto itself at region 38 to form a generally oval shape. The oval shape is preferred over a circular shape because an oval shape pendant can resist slippage on a earlobe to a greater extent than a circular shaped pendant. Wider regions 32 and 36 approach and recede from the widest zones in a tapered manner.

FIGS. 7 and 8 show alternating wide, narrow and wide regions 40, 42 and 44, respectively, in a pendant which is wave shaped. The wave shape imparts resistance against slippage of the earring during wearing.

FIG. 9 presents an isometric view of an oval earring 46, which is similar to the earring of FIGS. 5 and 6. FIG. 10 presents an isometric view of a wave shaped earring 48, which is similar to the earring of FIGS. 7 and 8.

FIG. 11 presents an isometric view of curled earring 50 having a curled portion 52 in the pendant which provides further resistance against slippage of the earring from the earlobe. By providing a plurality of curls 52 in series, or multicurls, a corkscrew configuration can be imparted.

While I have shown and described a present preferred embodiment of the invention, it is to be distinctly understood that the invention is not limited thereto but may be otherwise variously embodied within the scope of the following claims.

I claim:

1. A one-piece earring for wearing on an earlobe, said earlobe of the type having a hole formed therethrough, said hole defining a pierce in said earlobe, said earring comprising a protuberance of a size excessive for passing through said pierce, said protuberance resting against the outside of said earlobe, a substantially vertical pendant portion adapted for insertion through said earlobe pierce, said vertical pendant portion adapted to be worn extending downwardly from and below said earlobe, a shoulder portion having a diameter and adapted for penetrating said pierce and for spanning said earlobe at said pierce, said shoulder portion having one end connected to said protuberance and the other end continuous with said pendant portion, said shoulder portion forming an angle of no more than 110 degrees with respect to said vertical pendant portion, at least one region of said vertical pendant portion located adjacent the shoulder portion being relatively widened in cross section compared to the diameter of said shoulder portion by a dimensional ratio of at least 1.5 to 1 to resist slippage of said earring out of said earlobe pierce during wearing.

2. An earring of claim 1 wherein said shoulder portion forms an angle of no more than 100 degrees with respect to said vertical pendant portion.

3. An earring of claim 1 wherein said shoulder portion forms an angle of no more than 90 degrees with respect to said vertical pendant portion.

4. An earring of claim 1 wherein said shoulder portion is wire-like and said relatively widened region comprises a flattened region of said pendant.

5. An earring of claim 1 wherein said vertical pendant portion is at least 1.5 inches long.

6. An earring of claim 1 wherein said pendant is widened in a tapered manner along its length with the greatest widening occurring at an intermediate position along the length of the pendant.

7. An earring of claim 1 wherein said pendant has a relatively non-widened region relative to said shoulder portion.

8. An earring of claim 1 wherein said pendant has a plurality of said relatively widened regions separated by at least one relatively non-widened region relative to said shoulder portion

9. An earring of claim 1 wherein said pendant has a plurality of flattened relatively widened regions separated by at least one relatively non-widened region relative to said shoulder portion.

10. An earring of claim 1 wherein said pendant is shaped as an oval, said oval having an open end for insertion through said earlobe.

11. An earring of claim 1 wherein said pendant has a generally wave-like shape.

12. An earring of claim 1 wherein said pendant has a generally curl-like shape.

13. An earring of claim 1 wherein said pendant has a generally multicurl shape.

14. An earring of claim 1 wherein said ratio is at least 2 to 1.

15. An earring of claim 1 wherein the diameter of said shoulder portion is 0.5 to 1.25 mm.

16. An earring of claim 1 wherein said widened region is wire-like.

* * * * *